US011532217B2

(12) United States Patent
Filhol et al.

(10) Patent No.: US 11,532,217 B2
(45) Date of Patent: Dec. 20, 2022

(54) ALARM DEVICE DISTINGUISHING BETWEEN LAWFUL OCCUPIER AND INTRUDER

(71) Applicant: TELECOM DESIGN, Canejan (FR)

(72) Inventors: Didier Filhol, Canejan (FR); Eric Martin, Canejan (FR)

(73) Assignee: TELECOM DESIGN

( * ) Notice: Subject to any disclaimer, the term of this patent is extended or adjusted under 35 U.S.C. 154(b) by 390 days.

(21) Appl. No.: 16/636,098

(22) PCT Filed: Aug. 3, 2018

(86) PCT No.: PCT/FR2018/052013

§ 371 (c)(1),
(2) Date: Feb. 3, 2020

(87) PCT Pub. No.: WO2019/025743

PCT Pub. Date: Feb. 7, 2019

(65) Prior Publication Data

US 2020/0175829 A1 Jun. 4, 2020

(30) Foreign Application Priority Data

Aug. 4, 2017 (FR) ..... 1757533

(51) Int. Cl.
*G08B 13/08* (2006.01)
*E05B 81/76* (2014.01)
(Continued)

(52) U.S. Cl.
CPC ..... *G08B 13/08* (2013.01); *E05B 81/76* (2013.01); *G08B 25/008* (2013.01); *G08B 13/1645* (2013.01)

(58) Field of Classification Search
CPC combination set(s) only.
See application file for complete search history.

(56) References Cited

U.S. PATENT DOCUMENTS 4,410,884 A 10/1983 Heiland
9,589,446 B1 3/2017 Dey et al.
(Continued)

FOREIGN PATENT DOCUMENTS

WO 2016109335 7/2016

OTHER PUBLICATIONS

International Search Report issued in International Patent Application PCT/FR2018/052013 dated Nov. 8, 2018.

*Primary Examiner* — Joseph H Feild
*Assistant Examiner* — Sharmin Akhter
(74) *Attorney, Agent, or Firm* — Perman & Green, LLP

(57) ABSTRACT

An opening detection device for an opening element such as a door or window including a module that is applied to an inner side of the opening element, wherein the module includes means for detecting movement of the opening element, first presence detection means forming a conical beam defining what is termed a trust perimeter encompassing an operating distance over which an operator operates the mechanism for opening the opening element on the first side of the opening element, second presence detection means for detecting a presence on what is termed a mistrust perimeter circumscribed around the opening element and means for processing data from the detection means, for memory storage and for computation that are connected to the detection means.

19 Claims, 8 Drawing Sheets

(51) Int. Cl.
*G08B 25/00* (2006.01)
*G08B 13/16* (2006.01)

(56) References Cited

U.S. PATENT DOCUMENTS

| | | | | |
|---|---|---|---|---|
| 10,497,235 | B1 * | 12/2019 | Rogers | G08B 13/19658 |
| 2008/0061970 | A1 * | 3/2008 | Imai | G08B 13/08<br>340/541 |
| 2008/0157964 | A1 | 7/2008 | Eskildsen et al. | |
| 2012/0127317 | A1 | 5/2012 | Yantek et al. | |
| 2016/0189506 | A1 * | 6/2016 | Peterson | G08B 25/008<br>324/247 |
| 2016/0247370 | A1 | 8/2016 | Lamb et al. | |
| 2016/0341435 | A1 * | 11/2016 | Rabb | F24F 11/30 |

* cited by examiner

ALARM DEVICE DISTINGUISHING BETWEEN LAWFUL OCCUPIER AND INTRUDER

CROSS REFERENCE TO RELATED APPLICATIONS

This application is a National Stage of International Application No. PCT/FR2018/052013, having an International Filing Date of 3 Aug. 2018, which designated the United States of America, and which International Application was published under PCT Article 21(2) as WO Publication No. 2019/025743 A1, which claims priority from and the benefit of French Patent Application No. 1757533, filed on 4 Aug. 2017, the disclosures of which are incorporated herein by reference in their entireties.

BACKGROUND

1. Field

The present disclosure concerns an alarm device with opening detection of an opening element such as a door or window, provided with means enabling a discrimination between a lawful occupier and an intruder, in particular when the opening element is operated.

2. Brief Description of Related Developments

Many opening detectors exist in alarm systems. They are used, in particular, to protect residences, business premises or offices. In general, they are incorporated in a security system and connected by a wired or radio connection to a central alarm unit.

In order to protect these premises, most of the time the alarm systems have two types of sensors, detectors of opening of opening elements such as doors and windows and ultrasound or infrared movement detectors.

For a residence, for example, when the residence is empty the two types of sensors are in service. By contrast, when the residence is occupied, for example at night, only the door or window opening detectors are activated. This protection is called peripheral protection.

In such a case, it is obviously necessary to deactivate the alarm before opening the doors and/or windows.

Such a system is therefore constraining and the opening of an opening element such as a door or window from inside the premises will trigger false alarms.

However, it may be necessary to be able to open certain doors and windows from inside the protected premises without triggering the alarm.

Similarly, for business premises, it may be necessary to check from which side a door or window is opened, for example for a premises for which access is restricted but for which exit is unrestricted.

Documents US 2008/0157964 A1, US 2016/0247370 A1 and WO 2016/109335 A1 are known in this field and propose confirming or not confirming an opening element alarm depending on the presence or not of an occupant in the premises to be protected.

SUMMARY

In this context, the present disclosure proposes a device for detecting opening, optimally suited to discriminating attempts to open an opening element depending on the side where the opening attempt is located, in order to trigger an alarm in the case where an intruder is detected and to not trigger an alarm in the case where a legal occupier is detected, this device remaining usable even when an opening element is partially open.

More precisely, the present disclosure proposes an opening detection device for an opening element such as a door or window, comprising a module that is applied to an inner side of said opening element, wherein the module includes means for detecting movement of said opening element, first presence detection means forming a conical beam defining a so-called trust perimeter encompassing an operating distance over which an operator operates the mechanism for opening the opening element on the first side of the opening element, second presence detection means for detecting a presence over a so-called distrust perimeter circumscribed around the opening element and means for processing data from said detection means, for memory storage and for computation, connected to said detection means.

Said processing means are preferably configured to discriminate:

a)—alarm triggering event sequences, including:

- a detection of movement of the opening element by the movement detection means, without detection of an operator inside said trust perimeter by the first presence detection means,
- a detection of presence inside the distrust perimeter by the second presence detection means, without or before detection of presence of an operator inside said trust perimeter by the first presence detection means, and b)—non-alarm-triggering event sequences, including

- a detection of an operator inside the trust perimeter and then a detection of movement of the opening element,
- a detection of an operator inside the trust perimeter encompassing a detection of presence inside the distrust perimeter;

the module also comprising transmission means for transmitting an alarm that can be activated by the processing means according to the occurrence of one or other type of event.

In the case where the opening element has a stable restricted-opening position, insufficient for the passage of a person, and a fully-open position, allowing the passage of a person; the device preferably comprises means for detecting the position of the opening element, capable of discriminating between the closed, restricted-opening and fully-open positions of the opening element.

The processing, memory storage and computing means are advantageously connected to the position detection means and configured to trigger the alarm on detection of a change from the restricted-opening position to the fully-open position, without prior detection by the first presence detection means of an operator inside the trust perimeter.

The transmission means are preferably radio components allowing the transmission of an alert signal to a central alarm unit.

The device according to the disclosure may also, in an alternative or complementary manner, comprise LPWAN radio means and be capable of operating as an autonomous module for transmitting information and alarms to a remote alarm centre.

Advantageously, the programming logic of the device and its operating parameter setting can be modified by means of an external programming tool communicating with the device by Bluetooth connection that may or may not be low power.

The module is advantageously produced in an enclosure supplied by one or more batteries or by a solar cell and battery system.

The movement detection means can be magnetic means, an accelerometer, a magnetometer or any combination of these elements arranged in the module.

The first and/or second presence detection means are preferably infrared means or directional high-frequency radar means.

According to a particular aspect of the disclosure, the first presence detection means are formed from a combination of infrared emitting and receiving photodiodes configured to produce a first cone of detection directed towards the inside of the premises equipped with the opening element.

According to an advantageous aspect of the disclosure, the first presence detection means also comprise a PIR sensor (passive infrared sensor) equipped with a lens producing a second cone of detection surrounding or superimposed on the first cone, the presence detection being confirmed when the first and second detection means detect a presence.

The second presence detection means are advantageously formed from an infrared emitter/receiver and a conical focusing mirror producing a detection perimeter in the form of a disc around the device, preferably parallel to the opening element.

The disclosure also concerns an alarm system comprising at least one device according to the disclosure connected to a local or remote central alarm unit.

Advantageously, the device comprises, after placing the device on a first side of the opening element and switching on the device or alarm system, a detection procedure comprising:

- a first waiting loop, with the opening element closed, comprising waiting for a presence detection event on the presence detection means of the trust zone;
- a detection of the degree of opening of the opening element, making it possible to discriminate a full opening leading to a deactivation of the alarm from a partial opening triggering a second waiting loop waiting for one of the following events:

a) detecting movement of the opening element with detection of presence inside the trust perimeter;

b) detecting opening of the opening element without prior detection of presence inside the trust perimeter;

c) detection of presence inside the trust perimeter;

- a step of triggering the alarm on the occurrence of opening detection events of the opening element without prior detection of presence inside the trust perimeter (event b)) or detection of presence inside the distrust perimeter (event c));
- a step of deactivating the alarm and returning to a waiting mode in the case of a detection of the detection event of opening of the opening element with detection of presence inside the trust perimeter (event a)).

The device comprising means for measuring the opening of the opening element, the method can advantageously comprise a loop for detecting an incorrect half-open position and triggering a warning until attaining the correct half-open position of the opening element.

The device comprising means for measuring the opening of the opening element, the method preferably comprises a reactivation of the monitoring on exiting the full opening of the opening element and a return to the first waiting loop on return of the opening element to the closed position or a return to the second waiting loop on return of the opening element to the half-open position.

The device comprising a shock sensor, a shock detection triggers the alarm during a waiting loop.

The device comprising a magnetic Hall-effect sensor, a field variation detection triggers the alarm with opening element closed, without detection of movement of the opening element or detection of presence in the trust zone.

When the device comprises LPWAN communication means, the triggering of the alarm initiates a sending of one or more alarm frames over the LPWAN network.

BRIEF DESCRIPTION OF THE DRAWINGS

Other features and advantages of the disclosure will become apparent on reading the following description of a non-limiting exemplary aspect of the disclosure, with reference to the drawings which show.

DETAILED DESCRIPTION

The present disclosure has, for example, the goal of enabling activation of an alarm system in peripheral mode while continuing to live normally inside a residence without having to fear causing false alarms due to the activities of everyday life, such as opening a window in order to close the shutters or air a room, opening the door in order to take out the rubbish or to allow the dog to go out, or any other action on the opening elements from inside the secure perimeter, while an attempt to open the opening elements from the outside will trigger an alarm.

Figure 2:
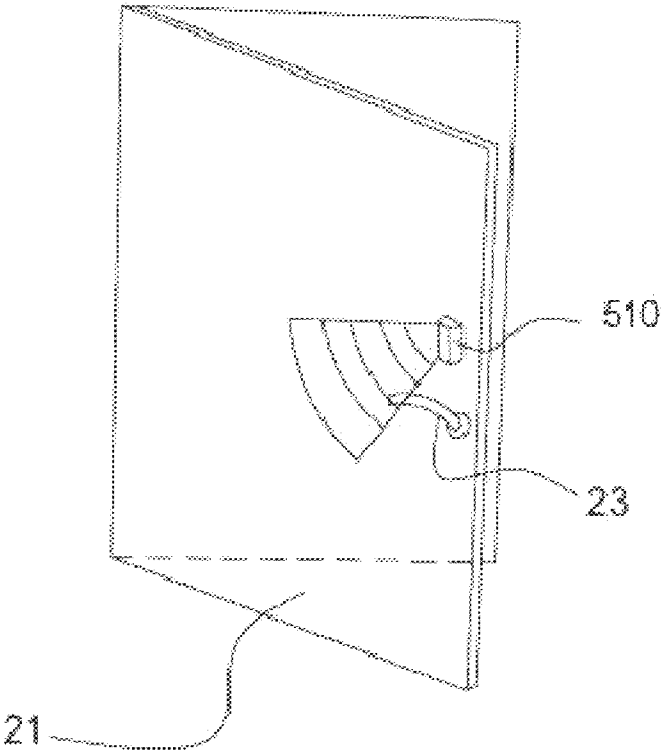
in FIG. 2: an example of the device of FIG. 1 positioned on a door.
Figure 1:
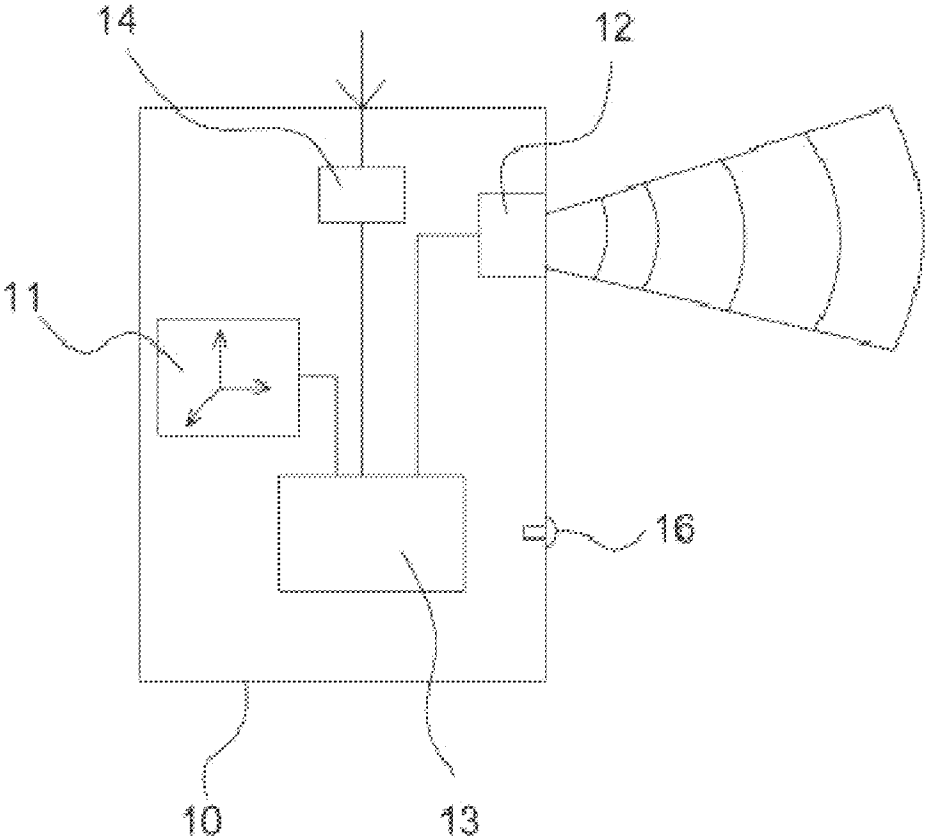
in FIG. 1: a schematic representation of a device for detecting opening of an opening element equipped with a presence sensor in a premises to be protected.
Figure 3:
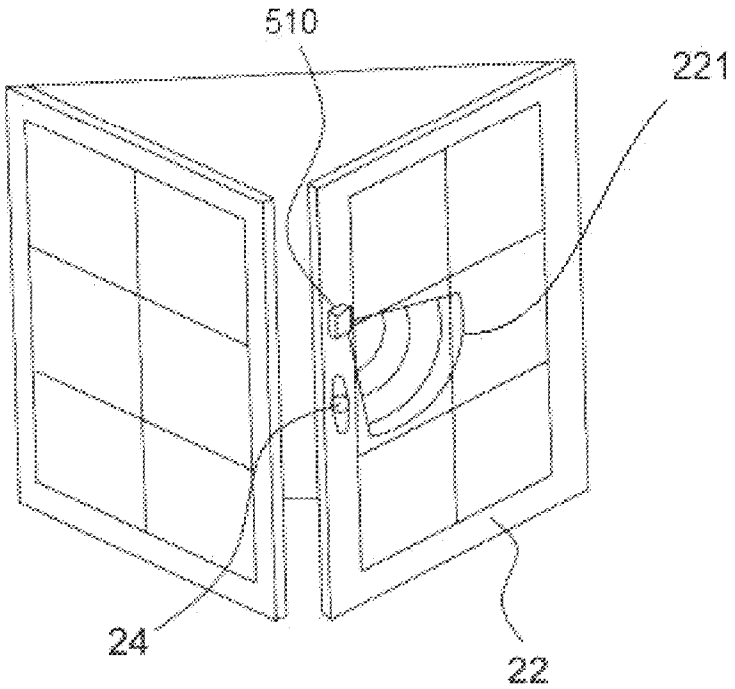
in FIG. 3: an example of the device to FIG. 1 positioned on a window.

The device shown schematically in FIG. 1 is an exemplary aspect of a device for protecting an opening element with single interior presence detection, which comprises a module 10 produced in the form of an enclosure 15 intended to be applied by bonding, screwing or other method to a first side of an opening element as shown in FIGS. 2 and 3.

This module can be equipped with a so-called "anti-tamper" device which automatically detects the change in its initial position such as, for example, in the case of an act of vandalism.

The module of FIG. 1 comprises means 11 for detecting movement of said opening element.

These detection means can be of several types, such as:

magnetic means, in this case an additional module such as a magnet or a metal mass is arranged opposite module 10 on a part of the stationary frame of the opening element to be protected;

a magnetometer which will directly detect the change in the direction of the Earth's magnetic field when the opening element is set in motion;

accelerometer-type means which will detect the opening element being set in motion, or any other means capable of detecting a setting in motion of the opening element.

The module also comprises means 12 for detecting presence in a restricted perimeter and located on one side only of the opening element.

The detection perimeter is circumscribed at an operating distance of the opening mechanism 23, 24 of the opening element operated by an operator.

The presence detection means can also be of several types, such as:

directional infrared means detecting the heat of an operator close to the device attached to the opening element;

radar means detecting reflection of the wave by the operator close to the device attached to the opening element.

The presence detection means are preferably directional or have a narrow cone of detection and are, for example, capable of detecting a presence over a reduced distance, for example up to 50 cm or up to 1 m from the opening mechanism of the opening element.

The illustrated device also comprises means 13 for processing, memory storage and computing, and transmission means 14.

The processing, memory storage and computing means are, for example, composed of a microprocessor or microcontroller comprising an analogue to digital converter and digital inputs and outputs and ROM and RAM memories. The transmission means 14 are composed of radio components allowing transmission of an AES secure alert signal.

The processing, memory storage and computing means are capable of processing data coming from the presence detection means according to a program stored in the device as discussed below, in order to allow the triggering of an alarm by means of the transmission means 14 to a central alarm unit or other monitoring centre according to a protocol programmed into the computing and storage memory means of the device.

The device also comprises a lithium battery or high-capacity battery voltage source, in order to provide a long operating time of several years. In order to improve this operating time, this device can be complemented or replaced by a solar cell and battery system.

Finally, the device may comprise a luminous indicator 16 which will give a visual indication during selected detection phases.

The goal of the disclosure is to discriminate opening attempts taking place on a first side of the opening element from opening attempts taking place on the other side of the opening element.

In order to do this, the module 10 is programmed to discriminate, on the one hand an event of detecting movement of the opening element with a presence detection and, on the other hand, an event of detecting movement of the opening element without a presence detection.

According to FIGS. 2 and 3, the enclosure 15 is arranged on the opening element, door 20 or window 22, at a location allowing reliable detection of a person operating the opening device of the opening element, for example the handle 23, 24 of a door or window, with presence detection means. In particular, the module can be positioned where the movement sensor can be configured in order to only detect persons at an operating distance from the opening element, in particular opposite the opening element.

The module comprises a program for low-consumption waiting for events and a wake-up system, for example by interruptions at a microprocessor or microcontroller of computing means 13 when the movement detection means 11 are activated by a movement of the opening element.

In order to guarantee this low-consumption aspect, for example hardware architectures based on very low voltage 32-bit ARM Cortex cores are used.

The module then enters a procedure searching for the presence of an operator on the side monitored by the presence detection means 12 by activating the infrared sensor or the HF radar.

Depending on the programming of the module according to the detection or not of presence, either no alarm is sent or an alarm is sent.

Figure 4:
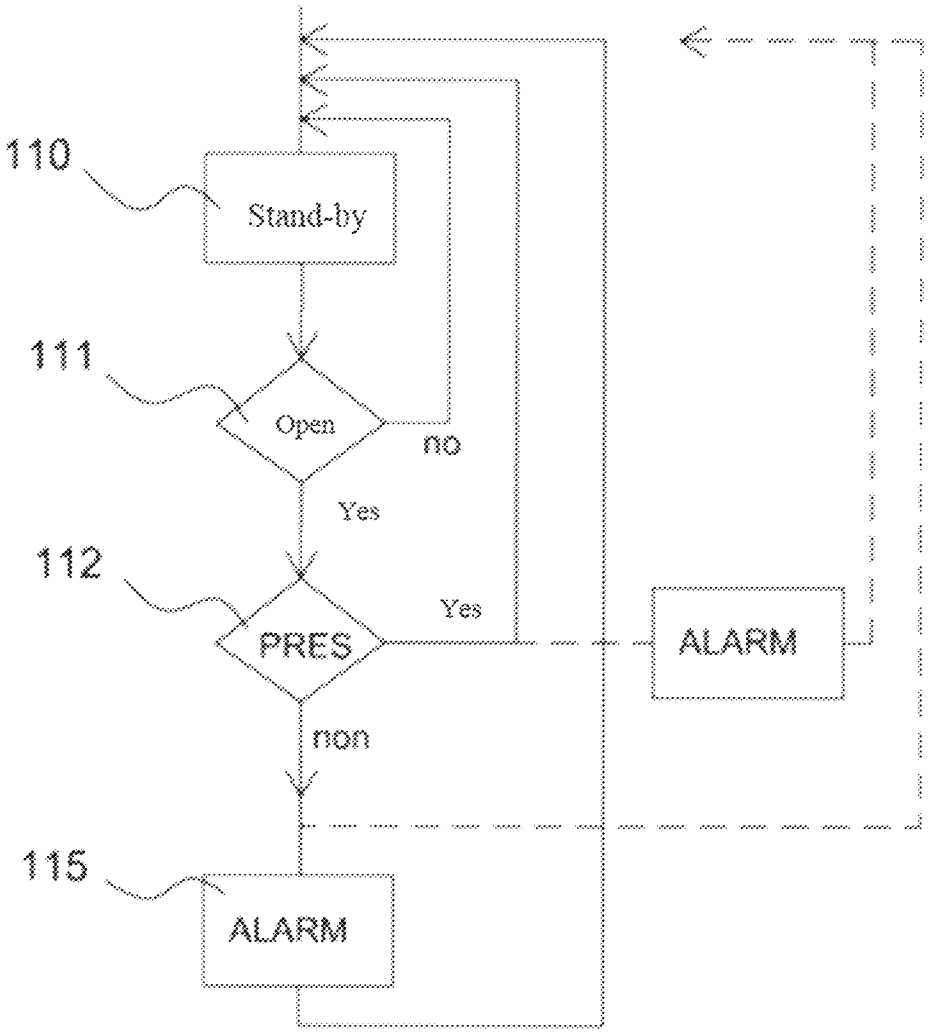
in FIG. 4: a flow diagram of the operation of the device according to FIGS. 1 to 3.

An example of a monitoring and detection method for such a simple device is shown schematically in FIG. 4. It comprises, after placing the device on the side of the opening element authorised for opening, a detection procedure comprising:

a waiting mode 110 comprising waiting 111 for an opening detection event and/or a presence event;

upon occurrence of an opening detection, a step 112 of searching for presence detection on the authorised opening side by means of the movement detector enabling a discrimination between a) detection of opening without detection of presence, and b) detection of opening with detection of presence; in the case described, a step of sending an alarm 115 in the case of detecting opening without detection of presence.

In the opposite case where, on detecting presence in step 112, an alarm sending step 115' (shown as a dotted line) is carried out, while the alarm is not sent if no presence is detected is also possible depending to the programming of the module.

According to the present disclosure, the device of FIG. 1 is optimised by using two main detection zones.

Figure 8:
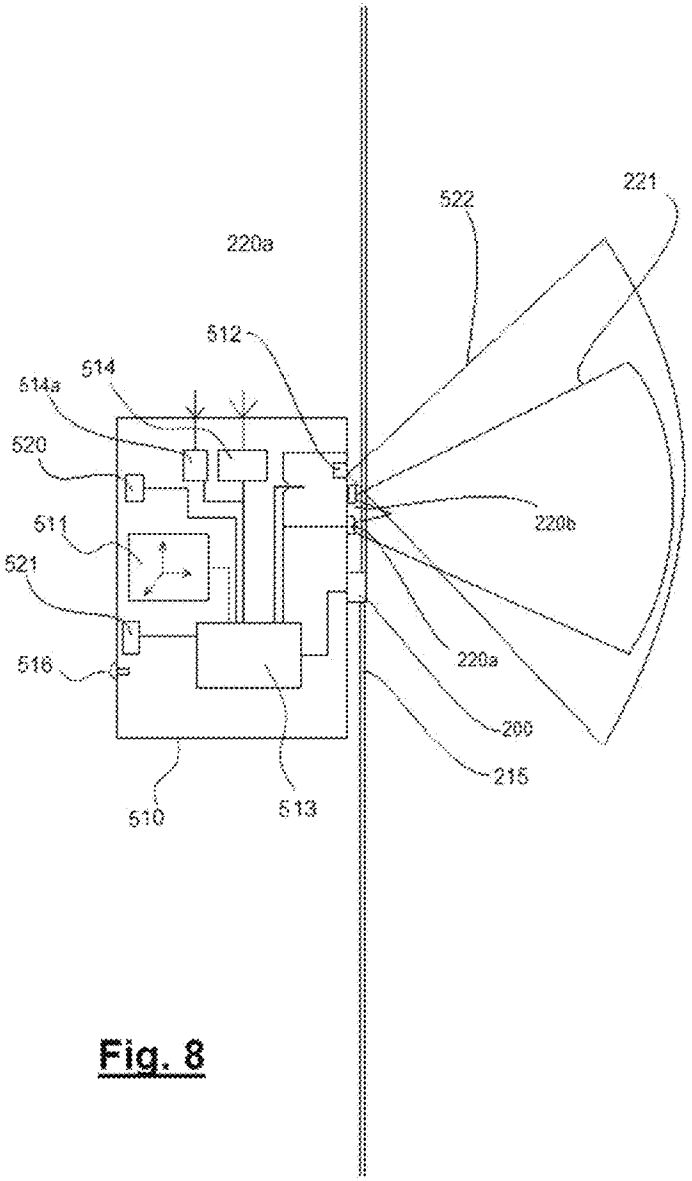
in FIG. 8: a schematic view of a device according to the disclosure.

With reference to FIG. 8 providing a schematic view of an exemplary aspect of a device of the present disclosure, a first main detection zone, called the trust perimeter, is a zone 221 materialised by a beam or detection zone allowing monitoring of a conical volume. The trust zone or perimeter is directed towards the inside of the premises. According to the example, the detection uses an active infrared sensor device with emitting diodes 19*a*, 19*b* and photo-receiver for detecting a person approaching the opening element from inside the premises to be protected.

A second main detection zone, called the distrust perimeter, is produced using an active or passive sensor 17 equipped with an optical device forming a detection disc 18 as close as possible to the opening element.

According to an improved version, a secondary detection zone is produced. This larger detection zone 522 surrounds the first in order to specify the detection in the trust perimeter. In order to produce this zone, a passive infrared sensor (PIR sensor) 512 is preferably used, which, when the first zone is covered by an active infrared sensor, makes it possible to work at two different wavelengths, which improves the detection. In this case, the detection in the trust zone is confirmed when the two detectors detect a presence. In the common detection zone, which is zone 221.

Figure 10B:
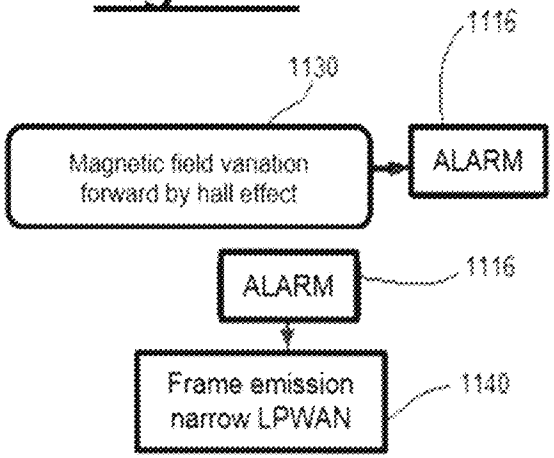
Figure 10C:
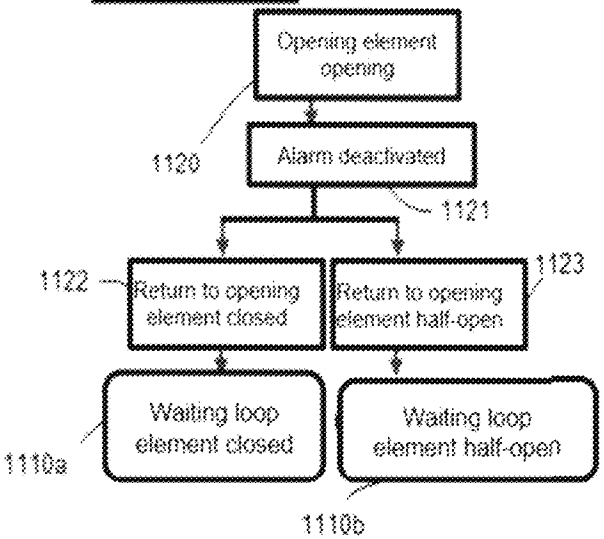
Figure 10A:
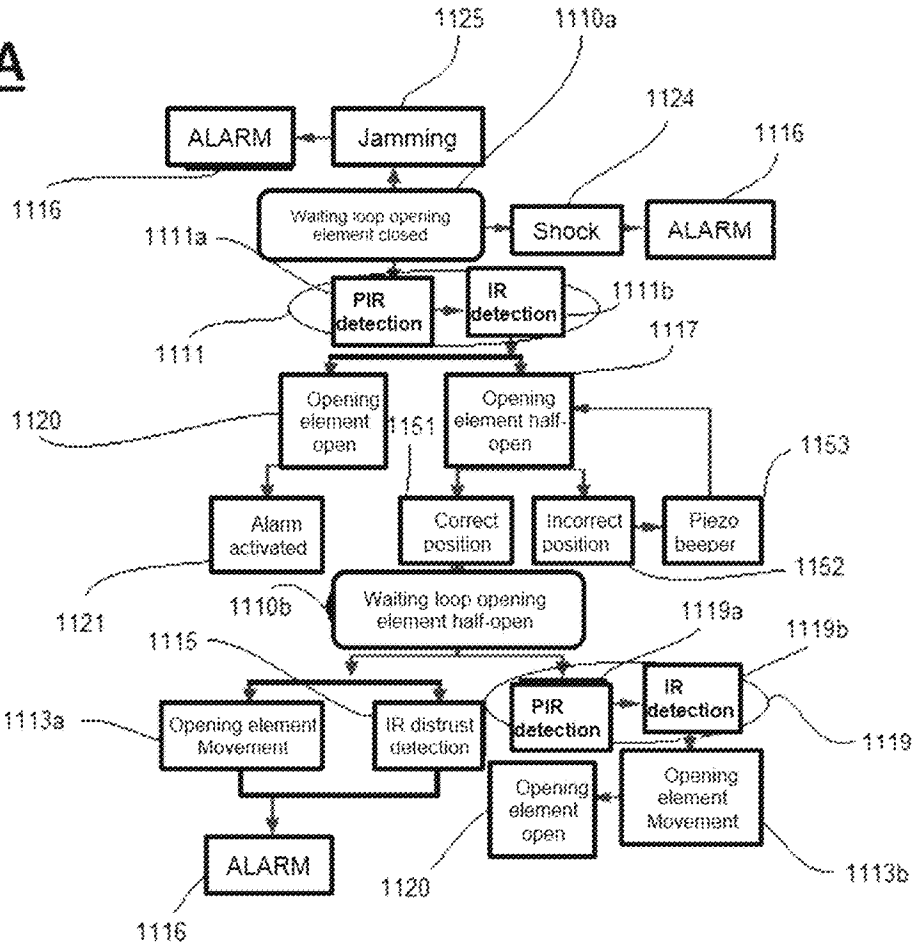

When a person approaches, said person is first detected by the PIR sensor 512 in the zone 522 and the device waits for a detection confirmation using the active infrared sensor covering the zone 221, which corresponds to steps 1111*a*, 1111*b* and 1119*a*, 1119*b* of FIG. 10A.

Figure 9:
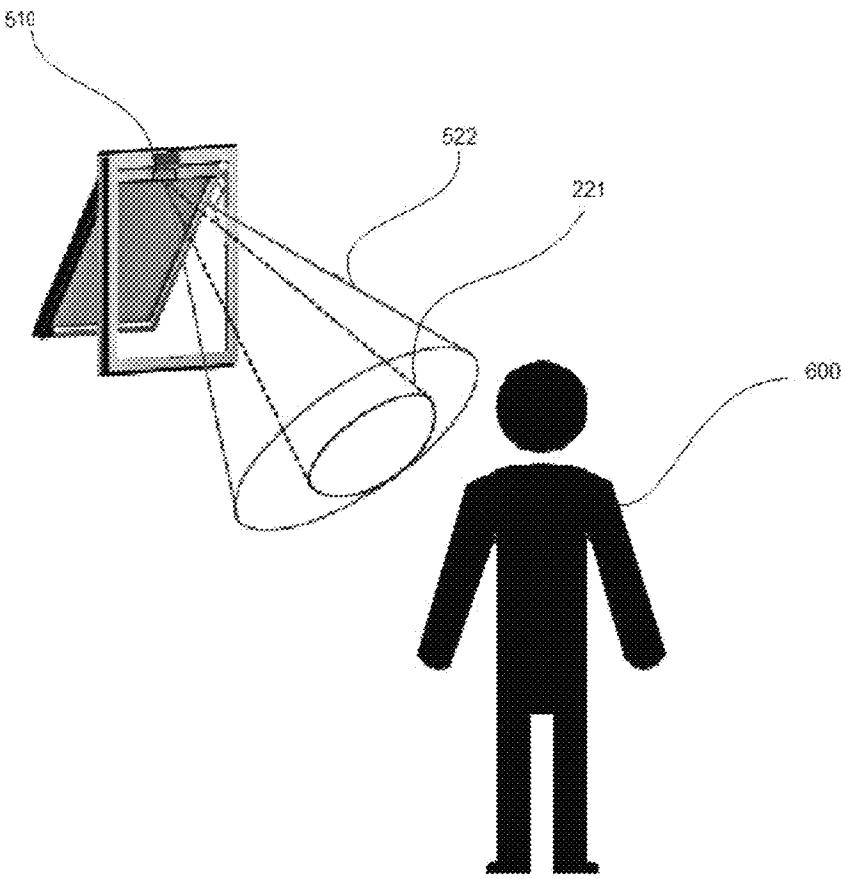
in FIG. 9: a perspective view of a variant of the device with double detection in the trust zone; and in FIGS. 10A to 10C: flow diagrams illustrating the operating phases of the device according to the disclosure.

The positioning of the trust zone corresponding to the detection cone 221 is materialised for example in FIG. 9, this zone being directed towards the inside of the premises in order to detect a person 600 authorised to operate the opening element.

Returning to FIG. 8, the device comprises a module 510 produced in the form of an enclosure intended to be applied by bonding, screwing or other method to an inner side of an opening element, just like the device of FIG. 1.

The module comprises movement detection means 511 of said opening element in the form of an accelerometer, comprises a magnetic sensor device 520 which interacts with a complementary element on the stationary frame in order to detect the opening and closing of the opening element, and comprises a shock detection device 521 for triggering an alarm in the event that an intruder strikes the opening element.

The Hall-effect magnetic sensor enables a field measurement capable of detecting a field variation representative of an intrusion attempt which will generate an alarm.

According to the disclosure, the module also comprises a plurality of presence detection means 512, 200, 220*a*, 220*b*, these means being intended:

for means 512, 220*a*, 220*b*, to detect a presence inside a trust perimeter and, for means 200, to detect a presence inside a distrust perimeter.

For its operation, the module comprises conventional data processing means 513 which comprise, as in the module of FIG. 1, a microprocessor or microcontroller, digital and/or analogue inputs/outputs, one or more RAM and ROM or reprogrammable memories and which are connected to the peripherals of the module, to the detection means 511, 520, 521, 200, 220*a*, 220*b*, 512 and to the radio emitter device 514.

The infrared detection devices are preferably used in pulsed mode, in order to reduce the electrical consumption of the enclosure.

Figure 5:
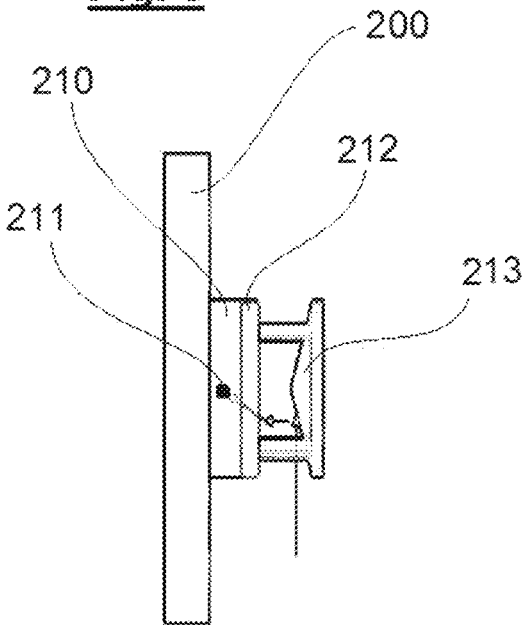
in FIG. 5: a side view of an infrared detector according to an aspect of the disclosure.

FIG. 5 shows a detail of an infrared detection device 200 assigned to the distrust zone.

It comprises an infrared sensor 211 behind a lens device 212 and opposite a conical mirror 213.

Figure 6B:
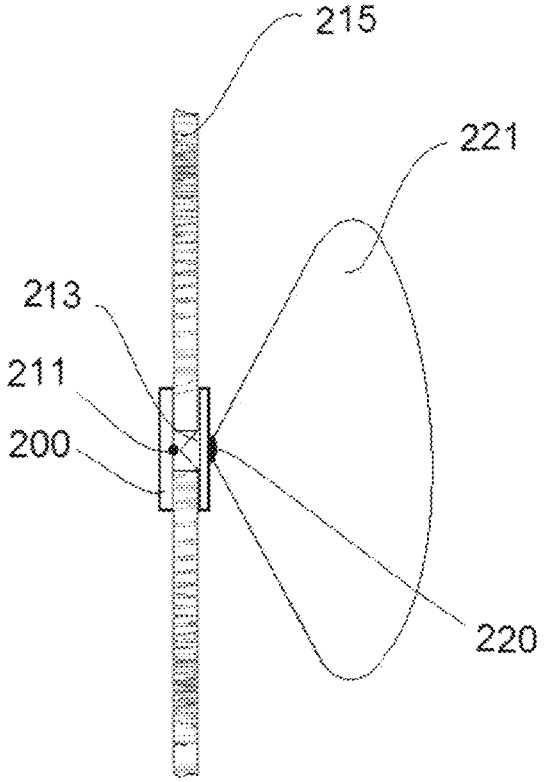
in FIGS. 6A and 6B: side view and top view of a device according to the disclosure with infrared detector for trust zone and distrust zone.
Figure 6A:
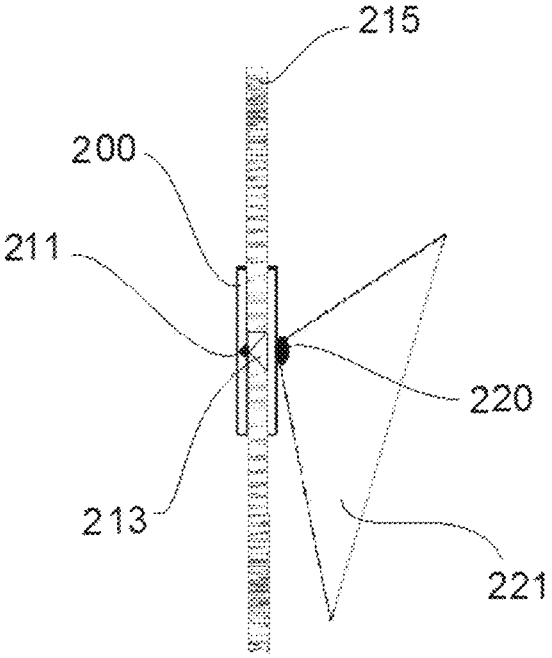

This device 200 can monitor a zone 215 in the form of a disc around the device, as shown in FIGS. 6A viewed from the side and 6B viewed from above.

The sensor is positioned on the device such that when the device is attached to the opening element, the detection disc is substantially parallel to the opening element and runs along the opening element.

The device 200 uses an active sensor and the infrared sensor 211 combines an emitter and a receptor that are offset along the axis of the mirror in order not to directly interfere with one another.

FIGS. 6A et 6B also show the conical detection perimeter 221 of the trust zone produced by means of an active infrared sensor 220 comprising one or more emitting LEDs and an infrared photoreceiver.

According to FIG. 6A, it can be seen that the detection disc of the distrust zone is parallel to the device and therefore parallel to the opening element to which the device is attached. The detection perimeter of the trust zone is, for its part, directed downloads inside the premises to be protected, as also shown in FIG. 9, in order to detect lawful users moving towards the opening element.

According to FIG. 6B viewed from above, the detection perimeter of the trust zone 221 is furthermore distributed equally to the right and to the left of the sensor 220.

Configurations suitable for premises and opening elements can be envisaged by changing the angle of detection of the sensor in the vertical or horizontal plane.

Figure 6C:
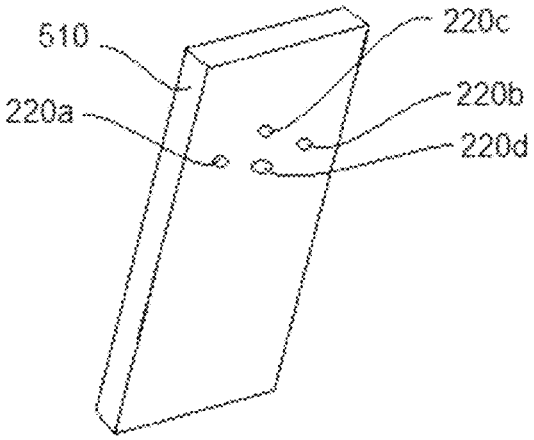
in FIG. 6C: a schematic perspective view of a detection device in the trust zone.

As shown schematically in FIG. 6C, the detection sensor of the trust zone can be produced using a plurality of infrared LEDs 220*a*, 220*b*, 220*c* covering an enlarged angular zone and a sensor 220*d*, such as a photodiode, receiving the infrared light emitted by the infrared LEDs and reflected by a person located in the covered zone.

FIGS. 7A to 7E illustrate the coverage zones for various types of opening elements.

Figure 7B:
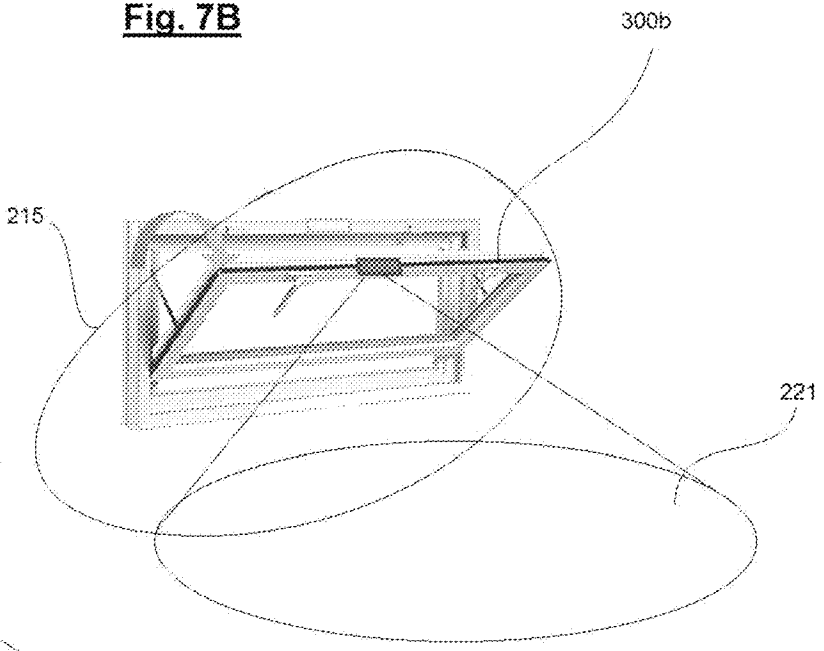
in FIGS. 7A to 7E: perspective views of various opening elements equipped with a device according to the disclosure.
Figure 7A:
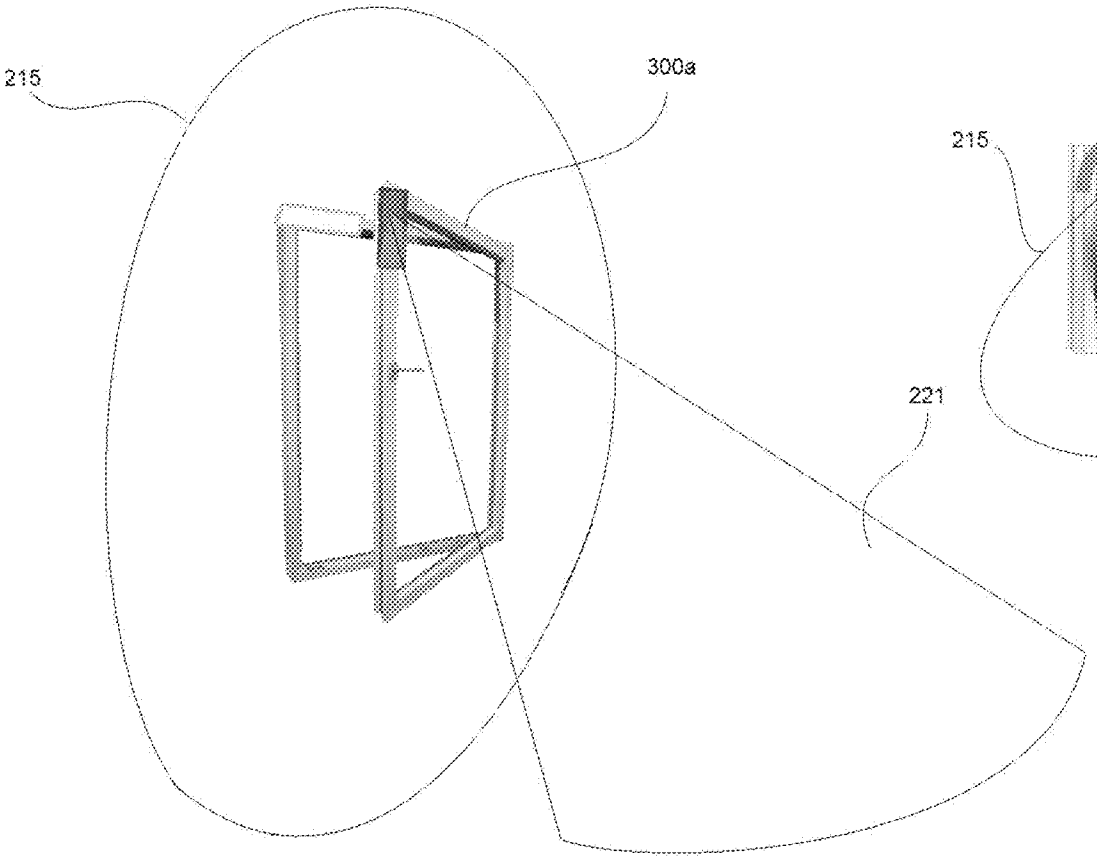

FIG. 7A shows a window with lateral opening.

When this window is half-open, as shown, the device is active and monitors the distrust zone 215 around the opening element and the trust zone 221 opposite the opening element.

By contrast, in the case where the window is wide open, the device is deactivated.

FIG. 7B shows a hopper window opening by rotation about a lower horizontal axis and the monitoring zones: distrust zone 215 around the opening element and trust zone 221 opposite the opening element when the window is half-open.

In the event that an intruder passes a hand through in order to open these windows, the detection in the distrust zone triggers the alarm.

Figure 7C:
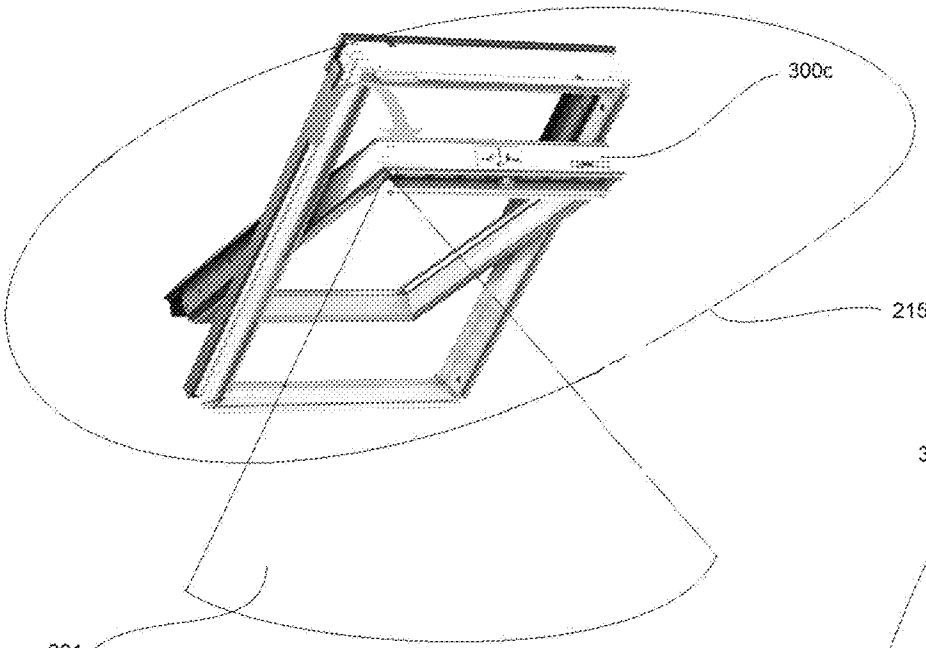
Figure 7D:
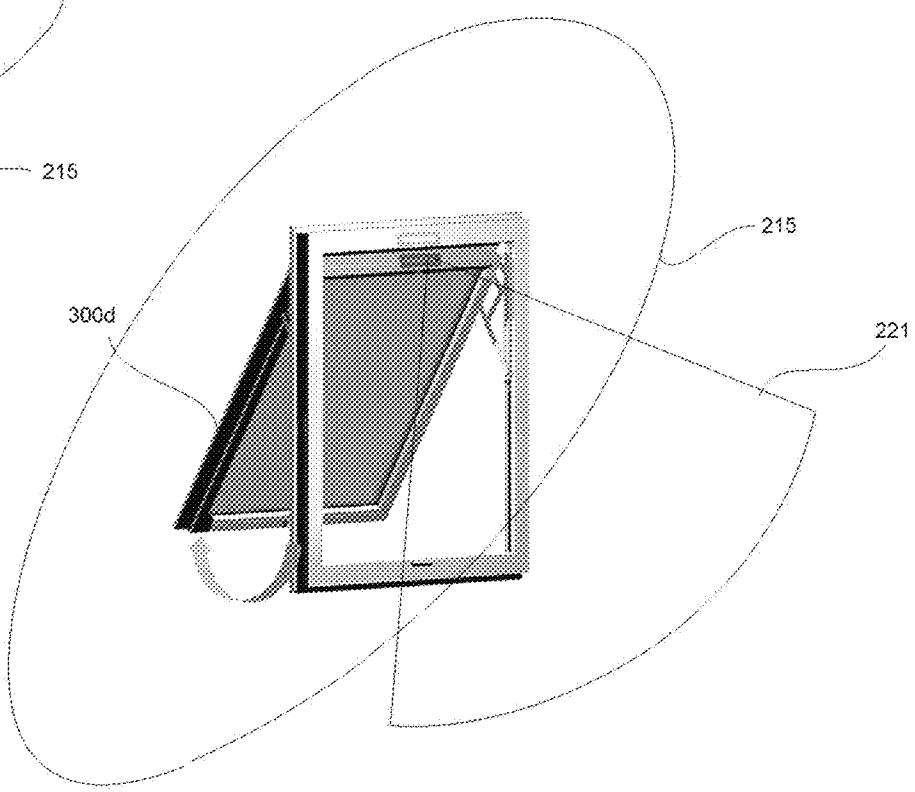

The same applies for the tilting window of FIG. 7C and the awning window opening about an upper horizontal axis of FIG. 7D.

Figure 7E:
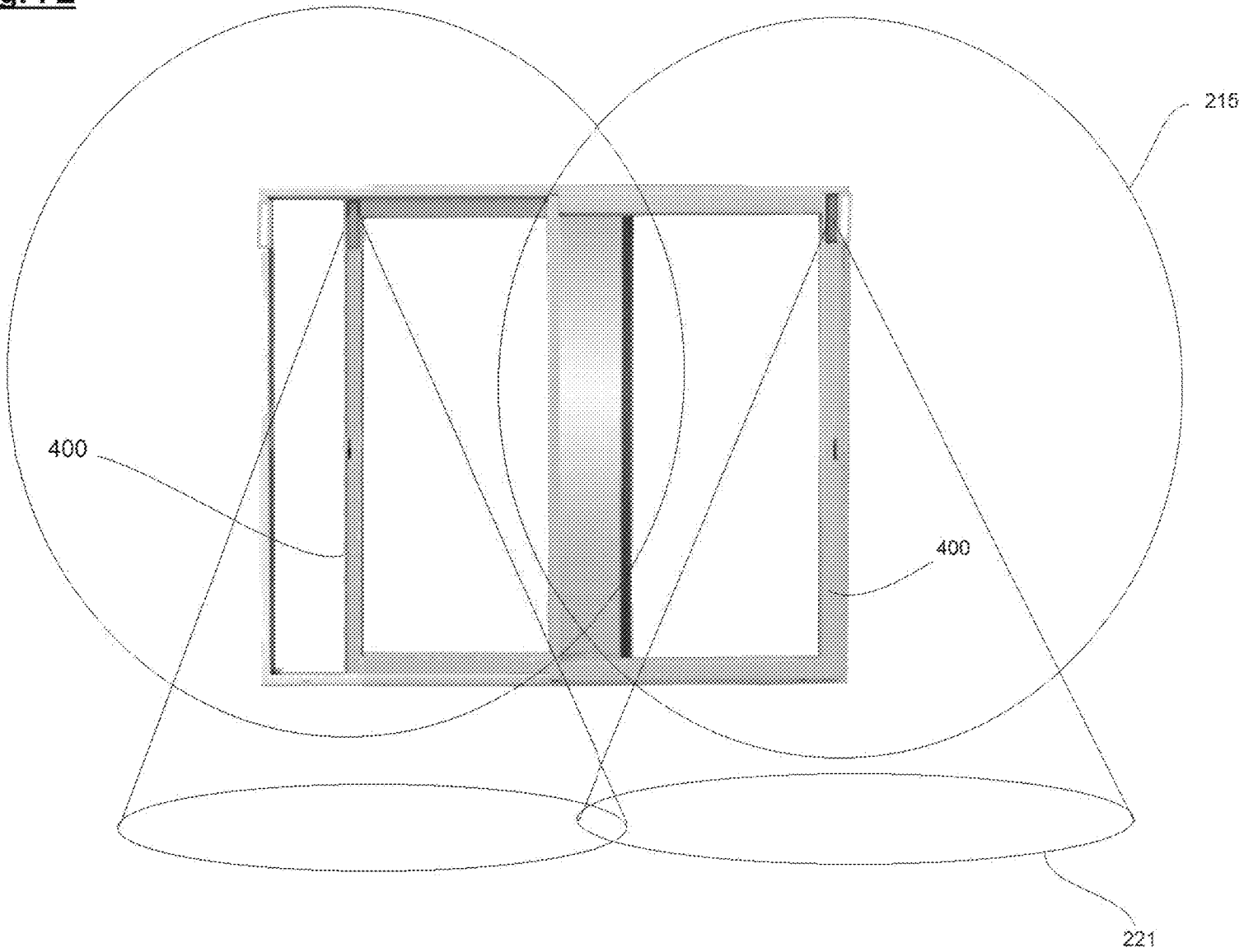

FIG. 7E shows a sliding window and, in this case, one device is used per panel.

In this last case, the device can remain active even when the sliding window is fully open.

As seen above, the trust zone may comprise two sensors making it possible to detect an enlarged approach 522 and a tight approach 221, the presence being confirmed when the two sensors detect a presence, in other words in the common perimeter 221 which is considered to be the trust perimeter. This makes it possible to increase the detection precision of the device.

Indeed, the use of two sensors makes it possible to better recognise an occupant who approaches the opening element and is then positioned in front of the opening/closing mechanism or who, once the mechanism has been used, moves away from the opening element, which makes it possible to obtain a logical sequence of events confirming a lawful action operating the opening or closing mechanism of the opening element.

In the detection method, the device will discriminate a plurality of situations, depending on the position of the opening element and of the sensor which is activated first.

Three main situations are distinguished:

Opening element closed/opening element half-open/opening element fully-open.

In the opening element fully-open situation, detected by the position sensors of the opening element, the device is deactivated because it is not usable.

When the opening element is in the half-open or semi-open position, the device, in contrast to a device with single sensor, remains active and operational. In this situation, it is able to discriminate between an operator approaching from the inside in order to enter into the trust zone, and an intruder passing his arm through or attempting to enter or to open the opening element and entering into the distrust zone.

This makes it possible to maintain protection of the premises or residence with half-open window or sliding windows, which provides additional comfort to the occupants relative to a system which must be deactivated once the opening elements are opened.

The module 510 attached to an inner side of said opening element makes it possible, due to:

the movement detection means 511, 520, 521 of the opening element, the first presence detection means forming a conical beam 221 defining a trust perimeter encompassing an operating distance over which an operator operates the opening mechanism 23 of the opening element on the first side of the opening element, second means for detecting presence on a distrust perimeter 215 circumscribed around the opening element and, means for processing data coming from said presence detection means, memory storage and computing 513, connected to said presence detection means;

to discriminate:

a)—alarm triggering event sequences, including:

a detection of movement of the opening element by the movement detection means, without detection of an operator inside said trust perimeter 221 by the first presence detection means, a detection of presence inside the distrust perimeter 215 by the second presence detection means, without or before detection of presence of an operator inside said trust perimeter by the first presence detection means, and b)—non-alarm-triggering event sequences, including a detection of an operator inside the trust perimeter 221 and then a detection of movement of the opening element, a detection of an operator inside the trust perimeter 221 encompassing a detection of presence inside the distrust perimeter 215.

Other sequences can be programmed according to the configuration of the premises or of the opening elements, the main triggering elements being the detection of a presence inside the distrust zone/perimeter or the detection of a movement of the opening element without detection of presence inside the trust zone/perimeter.

The module is connected to a central alarm unit by transmission means for transmitting an alarm that can be activated by the processing means according to the occurrence of one or other type of event for triggering the alarm on detection of an intruder.

As seen above, the opening element 300*b*, 300*c* has a stable restricted-opening position, insufficient for the passage of a person, and a fully-open position, allowing the passage of a person; the device further comprises means 511 for detecting the position of the opening element, capable of discriminating between the closed, restricted-opening and fully-open positions of the opening element, in order to maintain the protection of the premises not only when the opening element is closed, but also when the opening element is in restrained opening.

In this context, the processing, memory storage and computing means 513, connected to the means for detecting position and/or movement of the opening element, are configured in order to trigger the alarm on detection of a change from the restricted-opening position to the fully-open position, without prior detection by the first presence detection means of an operator inside the trust perimeter 221. This can be achieved by means of a tilt detector or an accelerometer.

FIGS. 10A to 10C show certain operating modes of the detection method. It should be noted that the exit from the waiting mode in particular can be made on receiving any information from the sensors which generates interruptions. The representation by sequential block diagram is therefore a simplified representation.

The method is such that, after placing the device on a first side of the opening element and activating the device, a detection procedure is initiated.

The detection procedure comprises, according to the example shown in FIG. 10A:

a first waiting loop 1110*a* which is activated when the opening element is closed. This loop comprises waiting for a presence detection invent 1111 on the present detection means of the trust zone. This presence detection is based on a detection by the PIR sensor 1111*a* followed and completed by a detection on the infrared sensor 1111*b*.

Following this detection, when the operating element is operated, a detection is initiated of the degree of opening of the opening element 1120, 1117. This detection makes it possible to discriminate a full opening 1120 leading to a deactivation of the alarm 1116 from a partial opening 1117 triggering a second waiting loop 1110*b* waiting for one of the following events:

a) detecting movement of the opening element 1113*b* with detection of presence inside the trust perimeter 1119;

b) detecting opening of the opening element without prior detection of presence inside the trust perimeter 1113*a;* c) detection of presence inside the trust perimeter 1115.

In cases b) and c), the method comprises a step of triggering the alarm 1116.

In case a), the method comprises a deactivation of the alarm and a return to a waiting mode.

In the case where the device comprises means for measuring the opening of the opening element, the method comprises a loop for detecting an incorrect half-open position and triggering a warning until attaining the correct half-open position of the opening element. This can cause the users to position the opening element in the correct position if this is not materialised by a hard point, for example.

FIG. 10C corresponds to the case where the device comprises means for measuring the opening of the opening element and where the method comprises a reactivation of the monitoring on exiting the full opening of the opening element. In this case, the process returns to the first waiting loop 1110*a* on returning 1122 the opening element to the closed position and returns to the second waiting loop 1110*b* on return 1123 of the opening element to the half-open position 1117.

When the device comprises a shock sensor, a shock detection 1124 triggers the alarm 1116 during a waiting loop, the first loop 1110*a* in FIG. 10A but also, if necessary, the second loop 1110*b*.

FIG. 10B shows the case where, the device comprising a magnetic Hall-effect sensor, a field variation detection 1130 triggers the alarm 1116 with the opening closed without detection of movement of the opening element or detection of presence in the trust zone.

This detection is made in the context of the first loop 1110*a*.

Similarly, FIG. 10B shows the case where, the device comprising LPWAN communication means, the triggering of the alarm 1116 initiates a sending of one or more alarm frames 1140 over the LPWAN network used by the device.

Another functionality of the device, applicable in particular in the case of a device comprising jamming detection means, is to be able to trigger an alarm in the event of radio jamming.

In a basic configuration, the device is formed from a peripheral module of a local central alarm unit and communicates with this on the ISM band. In an improved version, the device comprises LPWAN radio means, (Low Power Wide Area Network) in other words a low-power extended network, for example a network such as that developed by Sigfox or a network known under the name LoRa. In this case, the device is able to operate as an autonomous module for transmitting information and alarms via the LPWAN network to a remote alarm centre in the event of a communication fault with the central unit, for example in the event of radio jamming. In a totally autonomous version, the device is not connected to a local alarm unit but only to a remote centre and transmits its information and alarms directly to the remote alarm centre via the LPWAN network.

The radio means 514 of the device comprises, depending on the versions of the radio means communicating in the ISM band, radio means communicating in the bands suitable for the chosen LPWAN networks (ISM or other band).

In a version comprising jamming detection, the radio means are capable of detecting jamming in a plurality of bands including the ISM band and the GSM band, because an intruder equipped with a jamming device will attempt to jam all of the radio communications around and inside the premises.

In these versions provided with communication means with a remote centre, in the event of detecting jamming, the device is capable of sending frames in formats and using transmission modes which are insensitive to the jamming, such as narrowband or spread spectrum band.

In order to set the parameters of the device or to adapt its operating logic in order to modify, for example, the level of the IR signals, the sensed PIR sensitivity, the speed of movement, the angle of distrust or trust zones, the jamming frequencies and the detection sequences, the module of the device can also comprise a Bluetooth 514*a* radio connection, that may or may not be low-power, allowing connection to an external programming tool.

The device can be produced in a rectangular module which is placed either horizontally or vertically on a part of the frame of the opening element.

The sensor or sensors of the detection means of the trust zone can be rotated on the module in order to orientate the beam or the cone downwards, whatever the position of the module on the opening element.

The disclosure is not limited to the example shown and, for example, in the case of a door, the device can be programmed to deactivate following an opening of the door from the inside from the trust zone and to reactivate following the subsequent closing of the door, which enables the occupant to exit and then re-enter without having to deactivate the peripheral alarm. In addition, the presence detection means can have an orientable and adjustable detection distance.

What is claimed is:

1. An opening detection device for an opening element comprising:

an enclosure that is applied to an inner side of said opening element, the enclosure including a movement detector configured for detecting movement of said opening element;

a first presence detector forming a conical beam defining a trust perimeter encompassing an operating distance over which an operator operates the mechanism for opening the opening element on the first side of the opening element;

a second presence detector for detecting a presence over a distrust perimeter circumscribed around the opening elements;

a microprocessor for processing, memory storage, and computation of data from said movement detector, first presence detector, and second presence detector, the microprocessor connected to said movement detector, first presence detector, and second presence detector, wherein said microprocessor is configured to discriminate:

alarm triggering event sequences, comprising:

a detection of movement of the opening element by the movement detector, without detection of an operator inside said trust perimeter by the first presence detector, a detection of presence inside the distrust perimeter by the second presence detector, without or before detection of presence of an operator inside said trust perimeter by the first presence detector, and non-alarm-triggering event sequences, comprising:

a detection of an operator inside the trust perimeter and then a detection of movement of the opening element, and a detection of an operator inside the trust perimeter encompassing a detection of presence inside the distrust perimeter; and a transmitter for transmitting an alarm, activated by the microprocessor according to the occurrence of one or other type of event.

2. The device according to claim 1, wherein the opening element has a stable restricted-opening position, insufficient for the passage of a person, and a fully-open position, allowing the passage of a person; the device further comprises a position detector for detecting the position of the opening element capable of discriminating the closed, restricted-opening and fully-open positions of the opening element.

3. The device according to claim 2, wherein said microprocessor is connected to the position detector and configured in order to trigger the alarm on detection of a change from the restricted-opening position to the fully-open position, without prior detection by the first presence detector of an operator inside the trust perimeter.

4. The device according to claim 1, comprising an LPWA network configured to operate as an autonomous module for transmitting information and alarms to a remote alarm centre.

5. The device according to claim 1, wherein the transmitter is radio components enabling an alert signal to be transmitted to a local central alarm unit.

6. The device according to claim 1, wherein the programming logic of the device and its operating parameter setting is modified using an external programming tool communicating with the device by Bluetooth connection.

7. The device according to claim 1, wherein the device further comprises one or more batteries or a solar cell and battery system.

8. The device according to claim 1, wherein the movement detector is magnetic and/or an accelerometer and/or a magnetometer arranged in the enclosure.

9. The device according to claim 1, wherein the first and/or second presence detector are infrared or directional high-frequency radar.

10. The device according to claim 9, wherein the first presence detector comprises an active infrared sensor provided with infrared emitting and receiving photodiodes configured to produce a first cone of detection directed towards the inside of the premises equipped with the opening element.

11. The device according to claim 10, wherein the first presence detector further comprises a PIR sensor (passive infrared sensor) equipped with a lens producing a second cone of detection surrounding or superimposed on the first cone, the presence detection being confirmed when the active infrared sensor and the PIR sensor of the first presence detector detect a presence.

12. The device according to claim 1, wherein the second presence detector is formed from an infrared emitter/receiver and a conical focusing mirror producing a detection perimeter in the form of a disc around the device.

13. An alarm system comprising at least one device according to claim 1 connected to a local or remote central alarm unit.

14. A method for monitoring and detection with the device according to claim 1, comprising, placing the device on a first side of the opening element and switching on the device or alarm system, a detection procedure comprising:

a first waiting loop, with the opening element closed, comprising waiting for a presence detection event on the first presence detector of the trust perimeter;

a detection of the degree of opening of the opening element, to discriminate a full opening leading to a deactivation of the alarm from a partial opening triggering a second waiting loop waiting for one of the following events:

detecting movement of the opening element with detection of presence inside the trust perimeter;

detecting opening of the opening element without prior detection of presence inside the trust perimeter; and detection of presence inside the distrust perimeter;

a step of triggering the alarm on the occurrence of events detecting opening of the opening element without prior detection of presence inside the trust perimeter or detection of presence inside the distrust perimeter; and a step of deactivating the alarm and returning to a waiting mode in the case of a detecting a detection event of opening of the opening element with detection of presence inside the trust perimeter.

15. The method of monitoring and detection according to claim 14 wherein, the device includes an opening for measuring the opening of the opening element, the method comprises a loop for detecting an incorrect half-open position and triggering a warning until the attaining the correct half-open position of the opening element.

16. The method of monitoring and detection according to claim 14 wherein, the device includes an opening detector for measuring the opening of the opening element, the method comprises a reactivation of the monitoring on exiting the full opening of the opening element and a return to the first waiting loop on return of the opening element to the closed position or a return to the second waiting loop on return of the opening element to the half-open position.

17. The method for monitoring and detection according to claim 14 wherein, the device comprising a shock sensor, a shock detection which triggers the alarm during a waiting loop.

18. The method for monitoring and detection according to claim 14 wherein, the device comprising a magnetic Hall-effect sensor, a field variation detection triggers the alarm with the opening element closed, without detection of movement of the opening element or detection of presence in the trust perimeter.

19. The method for monitoring and detection according to claim 14, wherein the device comprises a LPWA network, wherein the triggering of the alarm, initiates a sending of one or more alarm frames over the LPWA network.

* * * * *